United States Patent [19]

Robinson

[11] 4,171,831

[45] Oct. 23, 1979

[54] CONTINUOUS STATIONERY ASSEMBLIES

[75] Inventor: Orville F. Robinson, London, England

[73] Assignee: Moore Business Forms, Inc., Niagara Falls, N.Y.

[21] Appl. No.: 897,909

[22] Filed: Apr. 19, 1978

[30] Foreign Application Priority Data

Apr. 21, 1977 [GB] United Kingdom ..... 16629/77

[51] Int. Cl.[2] ..... B41L 1/20

[52] U.S. Cl. ..... 282/12 A; 156/252; 156/263; 156/270; 282/21 D

[58] Field of Search ..... 156/252, 263, 270, 513, 156/517; 281/5, 14; 282/11.5 A, 12 A, 21 D, 1 A, 2-7; 283/62

[56] References Cited

U.S. PATENT DOCUMENTS

| | | | |
|---|---|---|---|
| 3,304,103 | 2/1967 | Bensler et al. | 282/11.5 A |
| 4,123,086 | 10/1978 | French | 282/21 R |

*Primary Examiner*—Gerald A. Dost

*Attorney, Agent, or Firm*—Allegretti, Newitt, Witcoff & McAndrews

[57] ABSTRACT

An improved letter sheet continuous stationery assembly is disclosed, and includes a front web and a backing web. Longitudinal and transverse cuts are made in the front web, but not the backing web, so as to define a plurality of letter sheets. The front and backing webs are permanently secured together along their side margins by lines of adhesive. The letter sheets produced in the front web are temporarily secured to the backing web by other lines of adhesive during the time the assembly is fed through additional forms handling equipment such as a computer controlled printer.

7 Claims, 2 Drawing Figures

CONTINUOUS STATIONERY ASSEMBLIES

BACKGROUND AND SUMMARY OF THE INVENTION

The present invention relates to continuous stationery assemblies, and more particularly, to a letter sheet continuous stationery assembly capable of generating or producing letter sheet documents which contain information, some printed and some typed, and which are useful, for example, for word processing applications. Such letter sheet documents are, for example, letters sent as sales promptional material.

In the past, such continuous stationery assemblies have been provided with longitudinal tear off perforations, have been printed with advertising material in the form of a typewritten letter and have had feed apertures provided in and along their side marginal edges. Subsequently, the continuous stationery assemblies are fed through a computer controlled printer and additional information, usually the name and address of the addressee as well as the date of the letter, is added. Sometimes additional information is also added in the body of the letter by the computer controlled printer. The position of the additional information is determined by the computer program, acting in conjunction with the feed pin continuous stationery assembly drive mechanism.

In further processing of the prior continuous stationery assembly, the side marginal portions containing the feed apertures are detached by means of longitudinal tear off perforations, and the continuous stationery assembly is divided into letter sheets. However, the letter sheets so generated or produced generally have shallow tabs formed at and along their side edges where the side marginal portions have been detached, and these shallow tabs constitute a serious drawback, from a commercial standpoint, to the use of such letter sheets because they make it obvious that the letter sheets were preprinted and generated on a computer controlled printer.

It is a principal object of the present invention to provide an improved letter sheet continuous stationery assembly. It is a further object of the present invention to provide an improved letter sheet continuous stationery assembly in which all of the edges of the letter sheets are straight edges.

According to one embodiment of the present invention, a letter sheet continuous stationery assembly comprises a first, front or top web and a second, backing or rear web. Both webs have side marginal feed apertures therein for feeding the webs, and thus the assembly, through a computer controlled printer and other forms handling equipment and have lines of adhesive along the side margins joining the two webs together. The front or top web, from which the letter sheets will be created, has a pair of longitudinal cuts therein, adjacent to its respective side margins, to define the side edges of each letter sheet to be formed from the front web. Transverse blocks are cut out of the front web to define the top and bottom edges of each letter sheet.

According to another aspect of the present invention, a method of producing an improved letter sheet continuous stationery assembly comprises: feeding a first, front web of a pair of webs from its respective manifold pack; cutting the first front web transversely at each letter length, i.e. adjacent to each of the manifold fold lines, to remove a transverse block from the front web so as to define the top and bottom edges of each letter sheet of the front web; feeding a second, backing web of the pair of webs from its respective manifold pack; applying adhesive to the side margins of one of the webs, i.e. on the face adjacent to the other web; collating and securing the front and backing webs together; and cutting the front web longitudinally, adjacent to each of its side margins, to define the side edges of each of the letter sheets.

These and other objects and advantages of the present invention will become apparent from the following description of the preferred embodiment of the present invention, described with reference to the accompanying drawings.

DESCRIPTION OF THE PREFERRED EMBODIMENT

Figure 1:
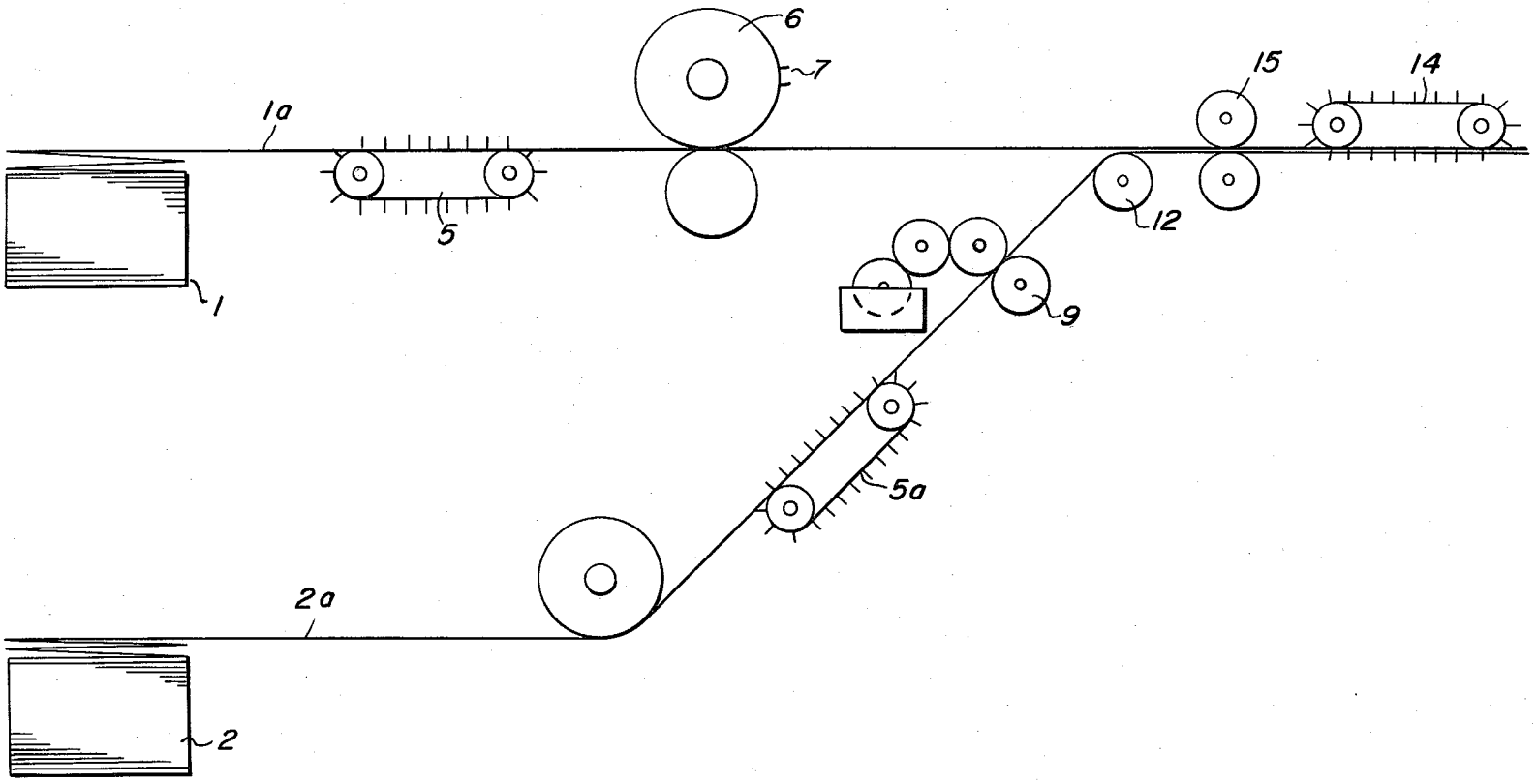
FIG. 1 is a diagrammatic view of the mechanism for making a letter sheet continuous stationery web assembly in accordance with the present invention.
Figure 2:
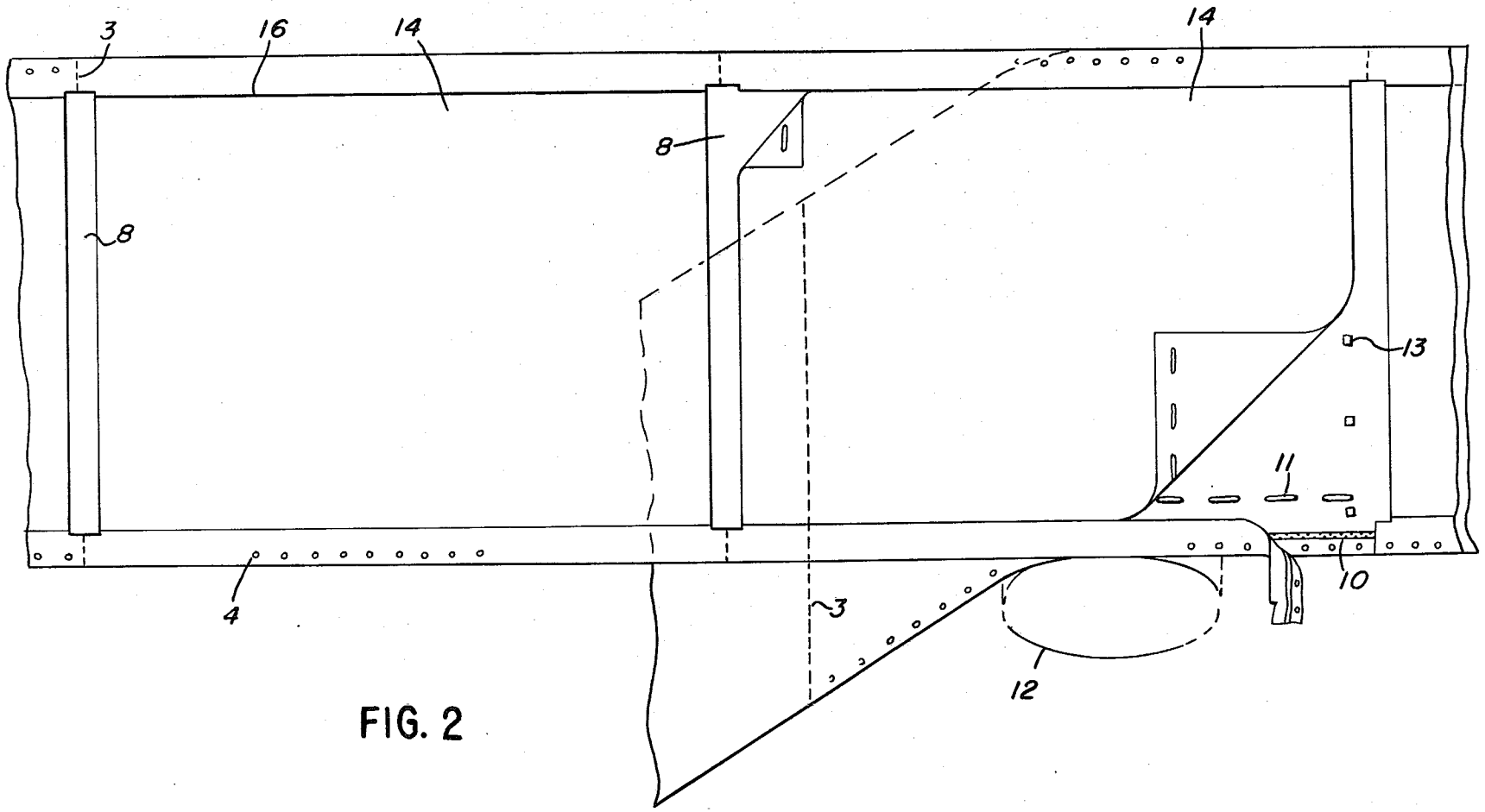
FIG. 2 is a detailed view of the letter sheet continuous stationery assembly being collated.

Referring to FIGS. 1 and 2 of the drawings, there is shown a first manifold pack 1 of a first front web 1*a*, and a second manifold pack 2 of a second, backing web 2*a*. Each web 1*a* and 2*a* has conventional feed apertures 4 formed in and along their side marginal edges and has transverse lines of tear off perforations 3 to divide the webs 1*a* and 2*a* into letter size lengths.

The front face of the front web 1*a* of the pack 1 is pre-printed with data or information, not shown, as for example, sales promotional information arranged in the form of a standard business letter. The front web 1*a* is fed from the manifold pack 1, as shown in FIG. 1, over a tractor pin feed mechanism 5 to a web cutting drum 6. Pairs of parallel blades 7, running longitudinally of the cutting drum 6 and spaced apart by a short distance, are mounted on the drum 6 and a pair of radial blades, not shown, also spaced apart, in order to permit the drum 6 to remove transverse blocks 8 of the web 1*a* at regular, pre-selected intervals, corresponding to and aligned with the perforations 3, so as to define the top and bottom edges of the eventual letter sheets.

A second backing web 2*a* is fed through a tractor feed mechanism 5*a* to a roller 12. The two webs 1*a* and 2*a* are collated together adjacent to the roller 12 so that their feed apertures 4 are aligned.

An adhesive applying mechanism 9 is located at the out feed side of the feed mechanisms 5*a* to apply a first, continuous line 10 of adhesive to and along each side of the front face of the web 2*a* just within the marginal feed apertures 4. The mechanism 9 also applies a second line 11 of adhesive, preferably in the form of a series of spaced spots of adhesive, to and along each side of the front face of the web 2*a* within the respective lines of the feed apertures 4 and spaced inwardly from the first lines 10. A transverse line 13 of adhesive is applied by the mechanism 9 adjacent to the top or leading edge of each letter length. The lines of adhesive 10, 11, and 13 on the front face or side of the backing web 2*a* serve to secure the two webs 1*a* and 2*a* together during the further printing of the front face of web 1*a* and the further handling of the webs 1*a* and 2*a*. The lines 10 permanently secure together the portions of the webs to the outside of the lines of marginal feed apertures 4, and the lines 11 and 13 secure the letter sheets temporarily to the portion of the backing web 2*a* within the lines of marginal feed apertures 4. Alternatively the adhesive could, of course, be applied to the underside or underface of the front web 1*a*.

The webs 1*a* and 2*a* are collated as they pass the roller 12 and they are pulled through respective pairs of slitters 15 by a pin feed tractor 14. The slitters 15 form a pair of longitudinal slits 16 in the web 1*a* adjacent to the feed apertures 4, but not in the web 2*a*, to define the cut side edges of the letter sheets.

Thus, the present invention provides a continuous letter sheet stationery web assembly consisting of a backing web 2*a* and a front web 1*a*. Both webs have marginal feed apertures 4 for feeding the assembly through a computer controlled printer, and have lines of adhesive in the respective margins of the webs to join the two webs together. A pair of longitudinal cuts are made in the top web adjacent to the respective side marginal edges to define the side edges of each letter sheet of the web, and transverse block cuts are made of the front sheet to define the top and bottom edges of each letter sheet. The collated and secured together webs 1*a* and 2*a* may be fed through a computer controlled printer by means of the pin feed drive mechanisms so that additional data, such as the name and address of the addressees, may be appropriately added to each letter sheet.

When webs 1*a* and 2*a* are fed out of the computer controlled printer, the side marginal portions can be cut off as by slitter mechanisms, from whence the letter sheets may be easily detached from the backing web 2*a* by virtue of the temporary adhesive connected in the form of lines 11 and 13 of adhesive.

In a modified form of the invention, pairs of parallel slits may be formed in and along the side edges of the web 1*a*, in place of slits 16, in order that a narrow strip of the front web 1*a* may be removed to retain the letter lengths and a continuous marginal reinforcement. Thus, since the invention disclosed herein may be embodied in other specific forms, without departing from the spirit or central characteristics thereof, the preferred embodiment described above is therefore to be considered in all respects as illustrative and not restrictive, the scope of the invention being indicated by the appended claims, rather than by the foregoing description, and all changes which come within the meaning and range of equivalency of the claims are therefore intended to be embraced therein.

I claim:

1. An improved letter sheet continuous stationery assembly for producing a plurality of clean edge letter sheets comprising:

a continuous backing web having feed apertures formed in and along its side marginal edges;

a continuous front web having feed apertures formed in and along its side marginal edges, the front and backing webs being superimposed on one another so that the feed apertures are aligned, and the front web having a pair of parallel longitudinal cuts therein, adjacent to the respective side marginal edges and inwardly of the feed perforations of the front web so as to define the side edges of each letter sheet to be formed from the front and having transverse blocks cut out of the front web at regular pre-selected intervals so as to define the top and bottom edges of each letter sheet;

means for securing the front and backing webs together between their side marginal edges and the longitudinal cuts; and means for temporarily attaching the portions of the front web, between the longitudinal cut and transverse blocks, to the backing web.

2. The improved letter sheet continuous stationery assembly described in claim 1 wherein the means for securing the front and backing webs together comprises lines of adhesive.

3. The improved letter sheet continuous stationery assembly described in claim 1 wherein the temporarily attaching means comprises lines of adhesive space adjacent to but inwardly of the longitudinal cuts.

4. The improved letter sheet continuous stationery assembly described in claim 1 wherein the transverse blocks extend outwardly beyond the longitudinal cuts.

5. A method for producing an improved letter sheet continuous stationery assembly for generating a plurality of clean edge letter sheets comprising the steps of:

feeding a front continuous web, which has feed apertures in and along its side marginal edges, along a first predetermined path;

cutting transverse blocks out of the front web, at regular, pre-selected intervals so as to define the top and bottom edges of each letter sheet, as the front web is fed along the predetermined path;

feeding a backing web, which has feed apertures in and along its side marginal edges, adjacent to the front web so that the front and backing webs are superimposed on one another, so that the feed apertures of the front and backing webs are superimposed and so that the backing web is also fed along the predetermined path;

securing the front and backing webs together between their side marginal edges and the longitudinal cuts;

cutting a pair of parallel, longitudinal cuts in the front web, adjacent to the side marginal edges and inwardly of the feed apertures so as to define the side edges of each letter sheet, as the front web is fed along the predetermined path; and temporarily attaching the portions of the front web, between the longitudinal cuts and the transverse blocks, to the backing web.

6. The improved method described in claim 5 including the step of applying lines of adhesive to the backing web adjacent to its side marginal edges prior to feeding the backing web adjacent to the front web for securing the front and backing webs together.

7. The improved method described in claim 5 including the steps of applying lines of adhesive to the backing web prior to feeding the backing web adjacent to the front web for temporarily attaching the portion of the front web to the backing web.

* * * * *